United States Patent [19]

Grimes

[11] Patent Number: 4,571,272

[45] Date of Patent: Feb. 18, 1986

[54] LIGHT METAL ALLOYS, PRODUCT AND METHOD OF FABRICATION

[75] Inventor: Roger Grimes, Gerrards Cross, England

[73] Assignee: Alcan International Limited, Montreal, Canada

[21] Appl. No.: 526,583

[22] Filed: Aug. 26, 1983

[30] Foreign Application Priority Data

Aug. 27, 1982 [GB] United Kingdom ..... 8224661

[51] Int. Cl.[4] ..... C21D 8/00

[52] U.S. Cl. ..... 148/11.5 A; 148/11.5 M; 148/420; 148/437; 420/902

[58] Field of Search ..... 148/11.5 A, 11.5 M, 148/420, 437, 12.7 A, 159, 161; 420/528, 542, 402, 533, 902

[56] References Cited

U.S. PATENT DOCUMENTS

| | | | |
|---|---|---|---|
| 1,620,081 | 3/1927 | Czochralski et al. | 148/437 |
| 3,876,474 | 4/1975 | Watts et al. | 420/533 |
| 3,984,260 | 10/1976 | Watts et al. | 148/11.5 A |
| 3,997,369 | 12/1976 | Grimes et al. | 148/11.5 A |
| 4,033,794 | 7/1977 | Stowell et al. | 148/11.5 A |
| 4,094,705 | 6/1978 | Sperry et al. | 148/11.5 A |
| 4,139,400 | 2/1979 | Bennett | 148/437 |

OTHER PUBLICATIONS

*Metals Handbook,* 8th Edition, "Cleaning and Finishing of Aluminum and Aluminum Alloys", 1964, pp. 616–617.

*Primary Examiner*—Melvyn J. Andrews
*Assistant Examiner*—Robert L. McDowell
*Attorney, Agent, or Firm*—Sheridan Neimark; Karl W. Flocks

[57] ABSTRACT

A method of superplastically forming an article from a light metal base alloy, of the kind capable of having its crystal structure modified by cold working in such a way that subsequent dynamic recrystallization by hot working is facilitated, comprises cold working a first blank of the alloy to form a second blank having the modified crystal structure, and then forming the second blank into the article by hot working so that dynamic recrystallization is induced and super plastic deformation occurs. The degree of modification of the crystal structure during cold working is such that as the dynamic recrystallization continues, the grain size is progressively refined.

6 Claims, No Drawings

LIGHT METAL ALLOYS, PRODUCT AND METHOD OF FABRICATION

This invention relates to a method of superplastically forming a light metal base alloy and to an article so formed. In this specification the term "light metal" is to be understood as meaning aluminium or magnesium.

Known aluminium base alloys that may usefully be deformed superplastically fall into three groups as follows:

GROUP 1

Alloys at or near a eutectic composition. Provided that such alloys are solidified sufficiently rapidly to give a fine mixture of the different phases an alloy which is inherently superplastic by hot deformation results. The extent to which such an alloy may be superplastically deformed appears to be substantially unaffected by further thermal or mechanical processing prior to the superplastic forming process. Good examples of such alloys are an Al/Ca eutectic or an Al/Ca/Zn eutectic. In such alloys it is believed that superplastic deformation occurs largely as a result of a grain boundary sliding mechanism.

GROUP 2

Alloys containing a constituent to encourage dynamic recrystallisation during subsequent hot working together with a constituent to provide a very fine scale dispersion of particles to control that recrystallisation. Such alloys are not inherently capable of superplastic deformation and only become superplastically deformable (i.e. sufficient dynamic recrystallisation occurs) during hot working, conveniently during the first stage of a superplastic forming process. In these alloys casting conditions are likely to be of crucial importance in order to obtain the optimum dispersion of fine particles during any subsequent hot working which may, for example, be as part of the superplastic forming process. In addition all thermal and mechanical processing prior to the final hot working step are also likely to be very important. This group includes the majority of alloys currently used commercially for superplastic deformation. Examples include Al/Cu/Zr such as 2004 and Al/Mg/Zr. All such alloys are usually heavily cold worked prior to the superplastic forming process.

GROUP 3

Alloys which are inherently superplastically deformable prior to the superplastic forming process. Such alloys are subjected to a complex sequence of thermal and mechanical processing to produce very fine grain size prior to superplastic deformation. In these alloys casting conditions are of less consequence, for superplastic properties, than subsequent thermal and mechanical processes which must be very carefully controlled. An example of such an alloy is Al/Zn/Mg/Cu such as 7475 used for its highest strength characteristics.

As stated above, the alloys of Group 2 constitute those most commonly used commercially for superplastic forming. All of them require the use of a grain control constituent added primarily to enhance subsequent superplastic deformation and all, require to be heavily cold worked before the superplastic formation process. During such process it is known that as deformation begins recrystallisation occurs giving a fully recrystallised, fine grain size after the article being formed is subjected to perhaps 100% strain. In the course of further deformation the mechanism of any further recrystallisation is not clear. It is possible that additional dynamic recrystallisation does not occur. Certainly it is known that excessive further deformation produces grain coarsening and thus can lead to failure of the deformed article.

The British Aluminium Company plc, assignors to the applicants, have very extensive experience in the development of light metal base alloys suitable for superplastic deformation. It had been widely believed, in the light metal industry and in academic circles, that light metal base alloys cannot be made to recrystallise dynamically during hot deformation. However as was shown in UK Pat. Nos. 1387586, 1445181 and 1456050 this belief was unfounded. It is now known that certain light metal base alloys can have their crystal structure significantly modified by cold working. The selection of such alloys and the extent of cold worked crystal structure modification thereof can profoundly affect the parameters of dynamic recrystallisation during subsequent hot deformation.

It is therefore an object of the present invention to provide an improved method of superplastically forming a light metal base alloy which enables more flexible working methods to be employed than has hitherto been possible.

A further object is to provide a method usable to provide strong but light weight superplastically formed articles.

According to one aspect of the present invention there is provided a method of superplastically forming an article from a light metal base alloy of a kind capable of having its crystal structure modified by cold working in such a way that subsequent dynamic recrystallisation by hot working is facilitated comprising cold working a first blank of the alloy to form a second blank having the modified crystal structure and forming the second blank into the article by hot working so that dynamic recrystallisation is induced therein and superplastic deformation occurs, the degree of modification of the crystal structure during cold working being such that as the dynamic recrystallisation continues the grain size is progressively refined.

The invention also provides a method of superplastically forming an article from a light metal base alloy selected from:

1. Li 1.5% to 4.0% by weight
   Mg 0% to 5.0% by weight
   Zr 0% to 0.4% by weight
   Cu 0% to 6.0% by weight
   Zn 0% to 5.0% by weight
   Al remainder with normal impurities
2. Lithium containing magnesium alloys including 10.0% to 15.0% by weight of lithium; and
3. Magnesium containing aluminium alloys including 6.0% to 12.0% by weight of magnesium, comprising cold working a first blank of the alloy to form a second blank having a modified crystal structure and forming the second blank into the article by hot working so that dynamic recrystallization is induced therein and superplastic deformation occurs and so that as the dynamic recrystallization continues the grain size is progressively refined.

In this specification "cold working" will normally be cold rolling or cold drawing of sheet, tube, bar or rod to produce the first "blank".

Suitable alloys may be selected from those containing the following elements:

(1)
Li 1.5% to 4.0% by weight
Mg 0% to 4.0% by weight
Zr 0% to 0.2% by weight
Cu 0% to 3.0% by weight
Zn 0% to 3.0% by weight
Al remainder with normal impurities (2) lithium containing magnesium alloys including more than 10.0% by weight of lithium and, as noted above, (3) magnesium containing aluminum alloys including 6.0% to 12.0% by weight of magnesium.

More particularly, suitable aluminum alloys are those selected from:

Li 2.0%
Li 3.0%; Zr 0.19%
Li 2.9%; Mg 2.20%; Zr 0.18%
Li 2.7%; Mg 2.8%; Zr 0.15%
Li 2.7%; Mg 0.7%; Cu 1.2%; Zr 0.09%
Li 2.8%; Mg 0.8%; Cu 2.5%; Zr 0.11%
Li 2.6%; Mg 1.0%; Cu 1.5%; Zr 0.16%; Zn 1.60%
Al remainder with normal impurities.

EXAMPLE I

The effect that the element lithium confers alone is illustrated in the case of super purity aluminium simply alloyed with 2% by weight of lithium. After chill casting this alloy, homogenising and hot rolling to 10 mm gauge, a first blank of this material was cold rolled to form a second blank of 1.5 mm gauge without an intermediate annealing step. The second blank was then superplastically formed by conventional techniques and the following superplastic elongations resulted:

| Temperature °C. | 450 | 480 | 500 |
|---|---|---|---|
| Superplastic elongation* | 210% | 320% | 190% |

*Determined in uniaxial tension, with a constant cross head velocity of 1.0 mm/min and an initial gauge length of 12.5 mm.

EXAMPLE II

An alloy of Al (99.86% pure)—2.7% Li—2.8% Mg—0.15% Zr was chill cast followed by homogenisation and hot rolling to a first blank thickness of 4 mm according to normal practice. The hot rolled material was then annealed, followed by cold rolling to a second blank having a gauge of 0.4 mm without an intermediate annealing step. The second blank was then superplastically formed by conventional techniques and the following superplastic elongations were obtained:

| Temperature °C. | 435 | 450 | 480 | 500 |
|---|---|---|---|---|
| Superplastic elongation* | 490% | 680% | 490% | 450% |

*Determined in uniaxial tension, with a constant cross head velocity of 12.5 mm/minute and an initial gauge length of 12.5 mm.

EXAMPLE III

An alloy of Al (99.86% pure)—2.5% Li—1.18% Cu—0.46% Mg—0.10% Zr was semi continuously, direct chill cast into a rolling block of 500 mm × 175 mm cross section. The block was homogenised and hot rolled to a first blank having a gauge of 5.5 mm. After annealing the hot rolled first blank it was cold rolled, without further annealing, to a second blank having a gauge of 1.5 mm. The second blank was then superplastically formed by conventional techniques and the following superplastic elongations were obtained:

| Temperature °C. | 480 | 500 | 520 | 540 |
|---|---|---|---|---|
| Superplastic elongation* | 490% | 615% | 610% | 420% |

*Determined in uniaxial tension with a constant cross head velocity of 6.25 mm/minute and an initial gauge length of 12.5 mm. It has been found that Mg up to 5.0%, Zr up to 0.4, Cu up to 6.0%, and Zn up to 5.0% may usefully be used. Also useful properties may be obtained with lithium containing magnesium alloys including 10.0% to 15.0% by weight of lithium and magnesium containing aluminum alloys including 6.0% to 12.0% by weight of magnesium.

The base alloys selected do not appear to need the addition of constituents provided primarily for grain control during superplastic deformation (although quantities of such constituents may be added for conventional grain refining in the initial casting process) and to produce enhanced physical characteristics such as strength and stress corrosion resistance and it appears that the dynamic recrystallisation process during superplastic deformation continues without consequent grain coarsening irrespective of the strain (certainly within the limits of conventional forming techniques) imposed during that deformation. This is a remarkable result and is contrary to all accepted teaching regarding the behaviour of superplastically deformable light metal base alloys as exemplified, for example, in Groups 1, 2 and 3 above.

We believe that the careful selection of light metal base alloys exhibiting the phenomenom of significant modification of crystal structure during cold working and in particular the addition of lithium to aluminium or magnesium or the addition of magnesium to aluminium in the quantities disclosed above profoundly alters the behaviour of the base alloy. This alteration may be a spontaneous recrystallisation during or at some time shortly after cold working such as cold rolling or cold drawing. This may be a consequence of a large fall in stacking fault energy. Alternatively if recrystallisation does not occur the modification of the crystal structure by cold working may create a structural pattern particularly suitable for subsequent superplastic deformation. In any event there will be much greater dynamic recrystallisation during hot superplastic deformation than with any other light metal base alloys known to be superplastically deformable. Again this is an unexpected result.

Because the development of dynamic recrystallisation appears to continue irrespective of the strain induced in the superplastic forming process, this enables the parameters of pressure, time and temperature to be varied more widely than has hitherto been possible with aluminum alloys.

It has also been found that the treatment afforded to light metal base alloys used in the process of the present invention, can be simplified. In particular the annealing step usual during cold rolling can be omitted without detriment to the subsequent superplastic performance of the base alloy.

When lithium is included in light metal alloys some tends to migrate to the surface to form one or more lithium compounds. Such compounds tend to inhibit superplastic forming because friction in the mould is increased and the flow of metal inhibited. When superplastically forming such lithium containing alloys therefore it is desirable to treat them chemically to remove the lithium surface compounds. This may most conveniently be done by pickling in nitric acid.

I claim:

1. A method of superplastically forming an article from a light metal base alloy selected from:

(1)

Li 1.5% to 4.0% by weight
Mg 0% to 5.0% by weight
Zr 0% to 0.4% by weight
Cu 0% to 6.0% by weight
Zn 0% to 5.0% by weight
Al remainder with normal impurities (2) lithium containing magnesium alloys including 10.0% to 15.0% by weight of lithium and (3) magnesium containing aluminium alloys including 6.0% to 12.0% by weight of magnesium comprising cold working a first blank of the alloy to form a second blank having a modified crystal structure and forming the second blank into the article by hot working so that dynamic recrystallisation is induced therein and superplastic deformation occurs and so that as the dynamic recrystallisation continues the grain size is progressively refined.

2. A method according to claim 1 in which the alloy selected from:

Li 1.5% to 4.0% by weight
Mg 0% to 4.0% by weight
Zr 0% to 0.2% by weight
Cu 0% to 3.0% by weight
Zn 0% to 3.0% by weight
Al remainder with normal impurities.

3. A method according to claim 2 in which the alloy is selected from:

Li 2.0%
Li 3.0%; Zr 0.19%
Li 2.9%; Mg 2.20%; Zr 0.18%
Li 2.7%; Mg 2.8%; Zr 0.15%
Li 2.7%; Mg 0.7%; Cu 1.2%; Zr 0.09%
Li 2.8%; Mg 0.8%; Cu 2.5%; Zr 0.11%
Li 2.6%; Mg 1.0%; Cu 1.5%; Zr 0.16%; Zn 1.60%
Al remainder with normal impurities.

4. A method according to claim 1 in which the alloy does not include any grain refining constituent added primarily to enhance subsequent superplastic deformation.

5. A method according to claim 1, including alloys selected from groups (1) and (2) in which the second blank is treated to remove lithium containing compounds from its surface prior to the hot working.

6. A method according to claim 1 in which the cold working of the first blank to form the second blank is carried out without an intermediate annealing step.

* * * * *